US009258633B2

(12) United States Patent
Yu

(10) Patent No.: US 9,258,633 B2
(45) Date of Patent: Feb. 9, 2016

(54) REAR COVER OF FLAT PANEL ELECTRONIC DEVICE AND FLAT PANEL ELECTRONIC DEVICE HAVING THE REAR COVER

(71) Applicant: NVIDIA CORPORATION, Santa Clara, CA (US)

(72) Inventor: Mingyi Yu, Shenzhen (CN)

(73) Assignee: NVIDIA Corporation, Santa Clara, CA (US)

( * ) Notice: Subject to any disclaimer, the term of this patent is extended or adjusted under 35 U.S.C. 154(b) by 67 days.

(21) Appl. No.: 13/746,803

(22) Filed: Jan. 22, 2013

(65) Prior Publication Data

US 2014/0133689 A1 May 15, 2014

(30) Foreign Application Priority Data

Nov. 9, 2012 (CN) ..... 2012 1 0447254

(51) Int. Cl.
*H04R 1/02* (2006.01)
*H04R 1/06* (2006.01)

(52) U.S. Cl.
CPC ..... *H04R 1/026* (2013.01); *H04R 1/025* (2013.01); *H04R 1/06* (2013.01); *H04R 2499/11* (2013.01); *H04R 2499/15* (2013.01)

(58) Field of Classification Search
CPC ..... H04R 1/025; H04R 1/026; H04R 1/06; H04R 2499/11; H04R 2499/15
USPC ..... 381/390; 248/176.3
See application file for complete search history.

(56) References Cited

U.S. PATENT DOCUMENTS

| | | | | |
|---|---|---|---|---|
| 6,724,614 | B1 * | 4/2004 | Chiang et al. | 361/679.44 |
| 8,488,832 | B2 * | 7/2013 | Leung | 381/387 |
| 2003/0221288 | A1 * | 12/2003 | Kim et al. | 16/337 |
| 2010/0072334 | A1 * | 3/2010 | Le Gette et al. | 248/176.3 |
| 2012/0006950 | A1 * | 1/2012 | Vandiver | 248/176.3 |

(Continued)

FOREIGN PATENT DOCUMENTS

| | | | |
|---|---|---|---|
| TW | 201112782 | A | 4/2011 |
| TW | M406760 | U | 7/2011 |
| WO | WO 2012112790 | A2 * | 8/2012 |

*Primary Examiner* — Duc Nguyen
*Assistant Examiner* — Sean H Nguyen
(74) *Attorney, Agent, or Firm* — Artegis Law Group, LLP

(57) ABSTRACT

The present invention provides a rear cover of a flat panel electronic device and a flat panel electronic device having the rear cover. A outer surface of the rear cover is provided with a recess and a supporting leg, the supporting leg is pivotably connected in the recess through a pivot means so as to enable the supporting leg to pivot between a retracting position and an unfolding position, the supporting leg is configured to be contained in the recess when being in the retracting position, and to make an angle with the rear cover when being in the unfolding position, a speaker is disposed in the supporting leg, sound holes are disposed at a position on a side wall of the supporting leg which is corresponding to the speaker, a through-hole is formed at a position of the rear cover which is corresponding to the pivot means, and an electric wire of the speaker passes through the through-hole to extend into the rear cover. The angle of the screen of the flat panel electronic device relative to the user can be adjusted through the supporting leg of the rear cover to improve the user's comfort level in watching, and the surface to be placed (such as the table surface) has no influence on the sound effect.

20 Claims, 6 Drawing Sheets

(56) References Cited

U.S. PATENT DOCUMENTS

2012/0118770 A1* 5/2012 Valls et al. ..... 206/320
2012/0170212 A1* 7/2012 Gallouzi et al. ..... 361/679.56
2012/0194448 A1* 8/2012 Rothkopf ..... 345/173
2012/0219169 A1* 8/2012 Tong ..... H04R 1/2811 381/332
2012/0248833 A1* 10/2012 Hontz et al. ..... 297/188.05
2012/0326003 A1* 12/2012 Solow et al. ..... 248/688
2013/0230202 A1* 9/2013 Widner et al. ..... 381/333

* cited by examiner

REAR COVER OF FLAT PANEL ELECTRONIC DEVICE AND FLAT PANEL ELECTRONIC DEVICE HAVING THE REAR COVER

CROSS-REFERENCE TO RELATED APPLICATIONS

This application claims priority to Chinese Patent Application No. 201210447254.9, filed on Nov. 9, 2012, which is hereby incorporated herein by reference.

BACKGROUND OF THE INVENTION

1. Field of the Invention

The present invention relates generally to a flat panel electronic device, in particular, to a rear cover of a flat panel electronic device and a flat panel electronic device having the rear cover.

2. Description of the Related Art

The present flat panel electronic device (including a tablet PC, a flat panel mobile phone such as iphone, etc.) is usually held by a user or placed on a table. However, the user would feel tired after prolonged handhold, if the flat panel electronic device is heavy because of its big screen. However, if the flat panel electronic device is placed on the table, the screen is parallel to the horizontal plane, and it brings about the inconvenience in watching and operating. In addition, the speaker of the flat panel electronic device and the sound holes corresponding to the speaker are disposed on the back by some designers to improve aesthetics. When the flat panel electronic device is placed on the table, a part of the sound holes may be covered by the table, and thus, the sound effect may be influenced. Moreover, the sound effect is further influenced, since the sound may be transmitted to the ears of the user after the reflection of the table.

Therefore, there is a need of providing a rear cover of a flat panel electronic device and a flat panel electronic device having the rear cover to solve the above problem in the prior art.

SUMMARY OF THE INVENTION

In order to solve the above problem, according to one aspect of the invention, a rear cover of a flat panel electronic device is provided. A outer surface of the rear cover is provided with a recess and a supporting leg, the supporting leg is pivotably connected in the recess through a pivot means so as to enable the supporting leg to pivot between a retracting position and an unfolding position, the supporting leg is configured to be contained in the recess when being in the retracting position, and to make an angle with the rear cover when being in the unfolding position, a speaker is disposed in the supporting leg, sound holes are disposed at a position on a side wall of the supporting leg which is corresponding to the speaker, a through-hole is formed at a position of the rear cover which is corresponding to the pivot means, and an electric wire of the speaker passes through the through-hole to extend into the rear cover.

Preferably, the supporting leg includes a first supporting leg and a second supporting leg, and the first supporting leg and the second supporting leg are disposed proximally to edges of two sides of the rear cover, respectively.

Preferably, two side walls of the supporting leg which are opposite in the thickness direction are provided with the sound holes.

Preferably, the sound holes are densely arranged on the side wall of the supporting leg, and diameters of the sound holes are 0.1 mm-1 mm.

Preferably, the angle is 60°-120°.

Preferably, a thickness of the supporting leg is less than or equal to 1 cm.

Preferably, the pivot means comprises a pivot axle and pivot holes, the pivot axle is connected to the rear cover in the recess, the pivot holes are disposed on the side walls of the supporting leg, the pivot axle passes through the pivot holes to enable the supporting leg to be pivotably connected to the recess.

Preferably, a top wall of the supporting leg is detachably connected to the side walls of the supporting leg, and notches whose opening directions are opposite are disposed on the top wall and the side walls respectively to form the pivot holes together.

Preferably, the pivot means further comprises a position-limiting component, the position-limiting component limits the supporting leg to the retracting position and the unfolding position when the supporting leg is at the retracting position and the unfolding position, respectively.

Preferably, the pivot axle is in a shape of tube, at least one of two ends of the pivot axle is fixed to the rear cover by the through-hole, a portion of the pivot axle located internally in the supporting leg is provided with an aperture, and the electric wire of the speaker passes through the aperture, the pivot axle and the through-hole to extend into the rear cover.

According to another aspect of the invention, a flat panel electronic device is also provided. The flat panel electronic device comprises a rear cover, a outer surface of the rear cover is provided with a recess and an supporting leg, the supporting leg is pivotably connected in the recess through a pivot means so as to enable the supporting leg to pivot between a retracting position and an unfolding position, the supporting leg is configured to be contained in the recess when being in the retracting position, and to make an angle with the rear cover when being in the unfolding position, a speaker is disposed in the supporting leg, sound holes are disposed at a position on a side wall of the supporting leg which is corresponding to the speaker, a through-hole is formed at a position of the rear cover which is corresponding to the pivot means, an electric wire of the speaker passes through the through-hole to extend into the rear cover so as to connect with an electric element of the flat panel electronic device.

Preferably, the supporting leg includes a first supporting leg and a second supporting leg, and the first supporting leg and the second supporting leg are disposed proximally to edges of two sides of the rear cover, respectively.

Preferably, two side walls of the supporting leg which are opposite in the thickness direction are provided with the sound holes.

Preferably, the sound holes are densely arranged on the side wall of the supporting leg, and diameters of the sound holes are 0.1 mm-1 mm.

Preferably, the angle is 60°-120°.

Preferably, a thickness of the supporting leg is less than or equal to 1 cm.

Preferably, the pivot means comprises a pivot axle and pivot holes, the pivot axle is connected to the rear cover in the recess, the pivot holes are disposed on the side walls of the supporting leg, the pivot axle passes through the pivot holes to enable the supporting leg to be pivotably connected to the recess.

Preferably, a top wall of the supporting leg is detachably connected to the side walls of the supporting leg, and notches whose opening directions are opposite are disposed on the top wall and the side walls respectively to form the pivot holes together.

Preferably, the pivot means further comprises a position-limiting component, the position-limiting component limits the supporting leg to the retracting position and the unfolding position when the supporting leg is at the retracting position and the unfolding position, respectively.

Preferably, the pivot axle is in a shape of tube, at least one of two ends of the pivot axle is fixed to the rear cover by the through-hole, a portion of the pivot axle located internally in the supporting leg is provided with an aperture, and the electric wire of the speaker passes through the aperture, the pivot axle and the through-hole to extend into the rear cover.

The rear cover of the flat panel electronic device provided by the invention is provided with the supporting leg, and the speaker is disposed in the supporting leg. Therefore, the angle of the screen of the flat panel electronic device relative to the user can be adjusted through the supporting leg to improve the user's comfort level in watching, and the surface to be placed (such as the table surface) has no influence on the sound effect. In addition, since the sound holes of the speaker are on the rear cover of the flat panel electronic device, the aesthetics of the flat panel electronic device also is uninfluenced.

A serial of simplified conceptions are incorporated into the summary of the invention, which will be further described in more detail in the detailed description. The summary of the invention neither implies that it is intended to limit the essential features and necessary technical features of the technical solution to be protected, nor implies that it is intended to define the protection scope of the technical solution to be protected.

Advantages and features of the present invention will be described in detail below in connection with the accompanying drawings.

BRIEF DESCRIPTION OF THE DRAWINGS

The following drawings of the present invention as a part of the present invention herein are used for understanding of the present invention, the embodiments and the descriptions thereof are illustrated in the drawings for explaining the principle of the present invention. In the drawings.

DETAILED DESCRIPTION

A plenty of specific details are presented so as to provide more thoroughly understanding of the present invention in the description below. However, the present invention may be implemented without one or more of these details, as is obvious to those skilled in the art. In other examples, some of the technical features known in the art are not described so as to avoid confusions with the present invention.

Figure 1:
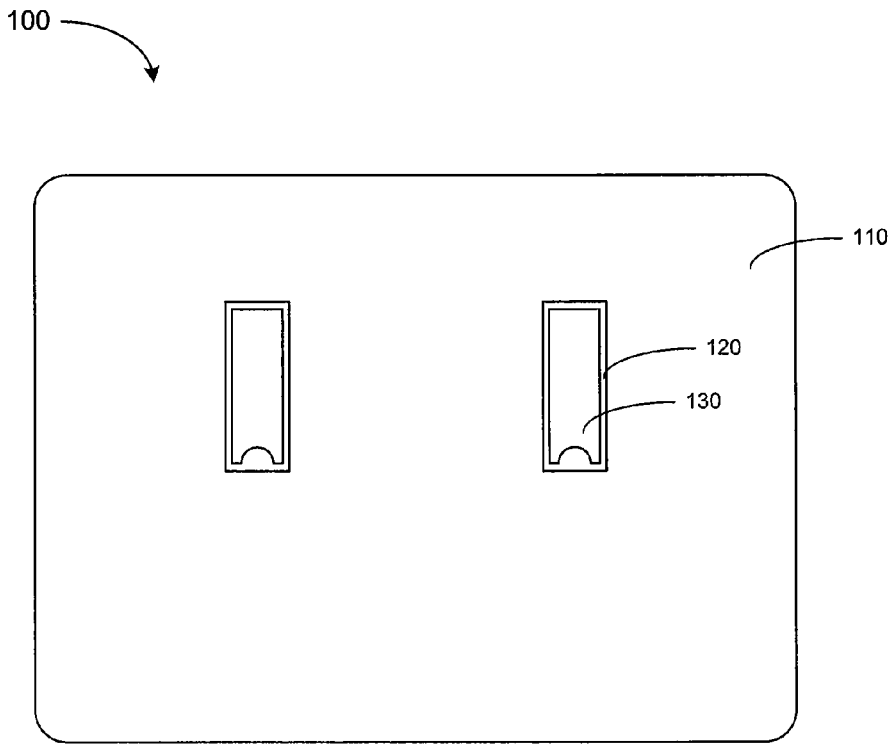
FIG. 1 is a back view of the flat panel electronic device according to one embodiment of the invention, wherein the supporting leg is in a retracting position.
Figure 2:
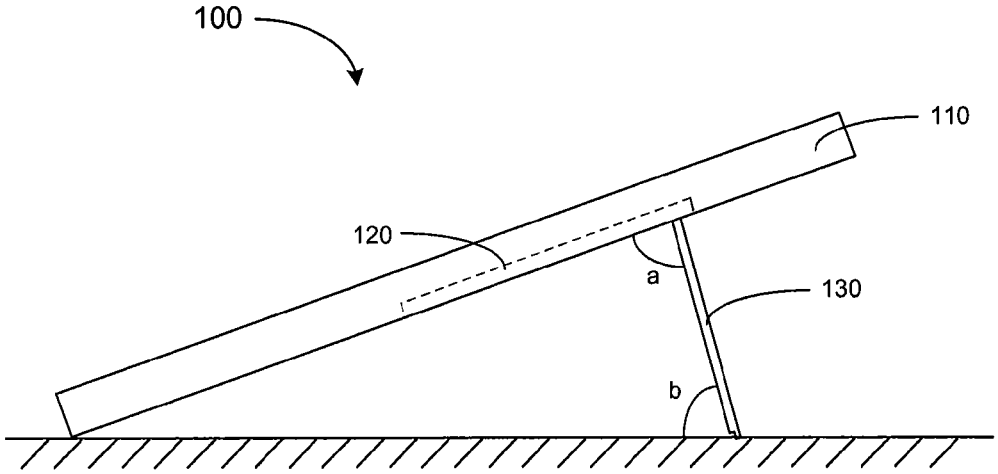
FIG. 2 is a right view of the flat panel electronic device according to one embodiment of the invention, wherein the supporting leg is in an unfolding position.

According to one aspect of the invention, a rear cover of a flat panel electronic device (hereinafter referred to as the rear cover) is provided. In order to generally understand the rear cover, the flat panel electronic device 100 will be first described below by combining with FIGS. 1-2. FIG. 1 and FIG. 2 are a back view and a right view of the flat panel electronic device according to one embodiment of the invention, respectively. As shown in FIGS. 1-2, the outer surface of the rear cover 110 of the flat panel electronic device 100 is provided with a recess 120 and a supporting leg 130. The supporting leg 130 illustrated in FIG. 1 is in a retracting position and is located in the recess 120. The supporting leg 130 illustrated in FIG. 2 is in an unfolding position and makes an angle with the rear cover 110. The "makes an angle with" means there is an angle between the supporting leg 130 and the rear cover 110.

The supporting leg 130 is pivotably connected in the recess 120 through a pivot means (not shown) so as to enable the supporting leg 130 to pivot between the retracting position and the unfolding position. The pivot means may have any structure which may pivotably connect the supporting leg to the recess 120. As an example, protrusions, which are for example in the shape of circles, cones, cylinders or frustums of cones, may be disposed on the two side surfaces of the recess 120, respectively, and moreover, depressions corresponding to the protrusions may be disposed on the supporting leg 130. The protrusions are pivotably connected to the depressions through containing the protrusions in the depressions. The positions of the protrusions and the depressions mentioned above may be exchanged. That is, the protrusions are disposed on the supporting leg 130 and the depressions are disposed in the recess 120. Alternatively, a pivot axle may be disposed on one of the recess 120 and the supporting leg 130, and pivot holes are disposed on the other of them. The supporting leg 130 is configured to be contained in the recess 120 when being in the retracting position, such that the surfacing flatness of the rear cover 110 cannot be influenced when the supporting leg 130 is unused. And, the supporting leg 130 makes an angle with the rear cover 110 when being in the unfolding position, as shown in FIG. 2. In this way, the angle of the screen of the flat panel electronic device 100 relative to the user can be adjusted through the supporting leg 130, to improve the user's comfort level in watching.

Besides that the comfort level is able to be improved, a speaker (not shown) is also disposed in the supporting leg 130 in the invention, and sound holes (referring to the reference number 220 illustrated in FIG. 3) are disposed at the position on the side wall of the supporting leg 130 which is corresponding to the speaker. A through-hole is formed at the position of the rear cover 110 which is corresponding to the pivot means, such that an electric wire of the speaker can pass through the through-hole to extend into the rear cover 110 to connect the speaker with electrical elements of the flat panel electronic device. The electrical elements may include a printed circuit board, a processor and a sound card, etc. In this way, the sound effect is not influenced, even if the user place the flat panel electronic device 100 on the table.

In addition, although the supporting leg 130 illustrated in FIGS. 1-2 is in the shape of a general flat cuboid, the invention is not intended to limit the shape of the supporting leg 130. The supporting leg 130 may have other geometrical shape or other designed shape for satisfying the requirements from different users. Moreover, the invention is also not intended to limit the number of the supporting leg 130, and it may be one or more than two.

Figure 3:
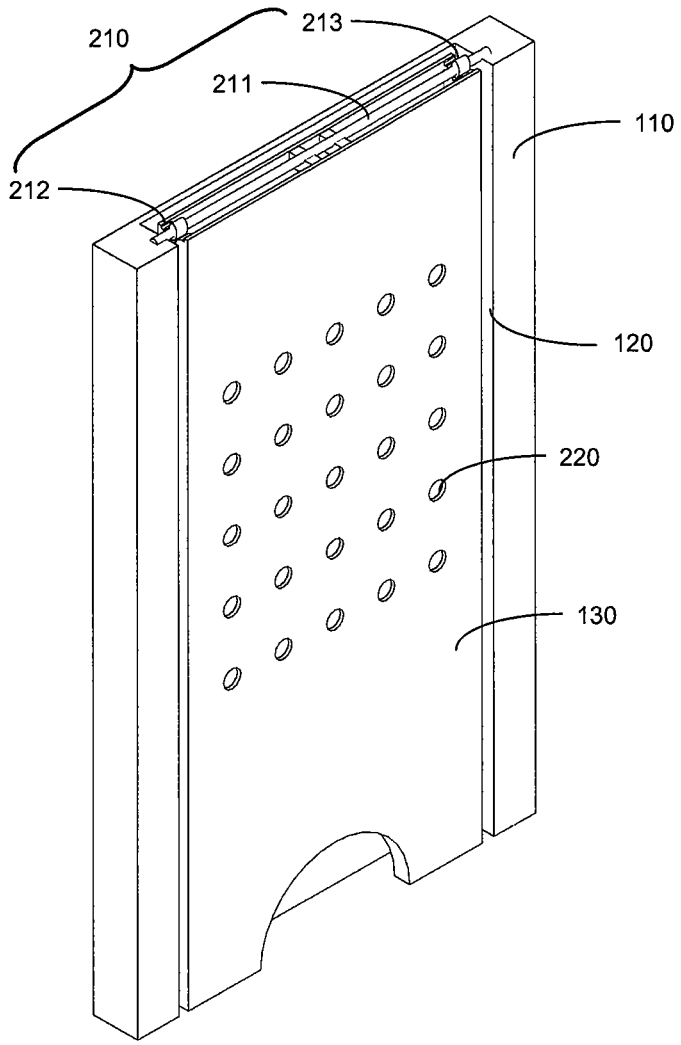
FIG. 3 is a partial perspective view of the rear cover according to one embodiment of the invention.
Figure 4:
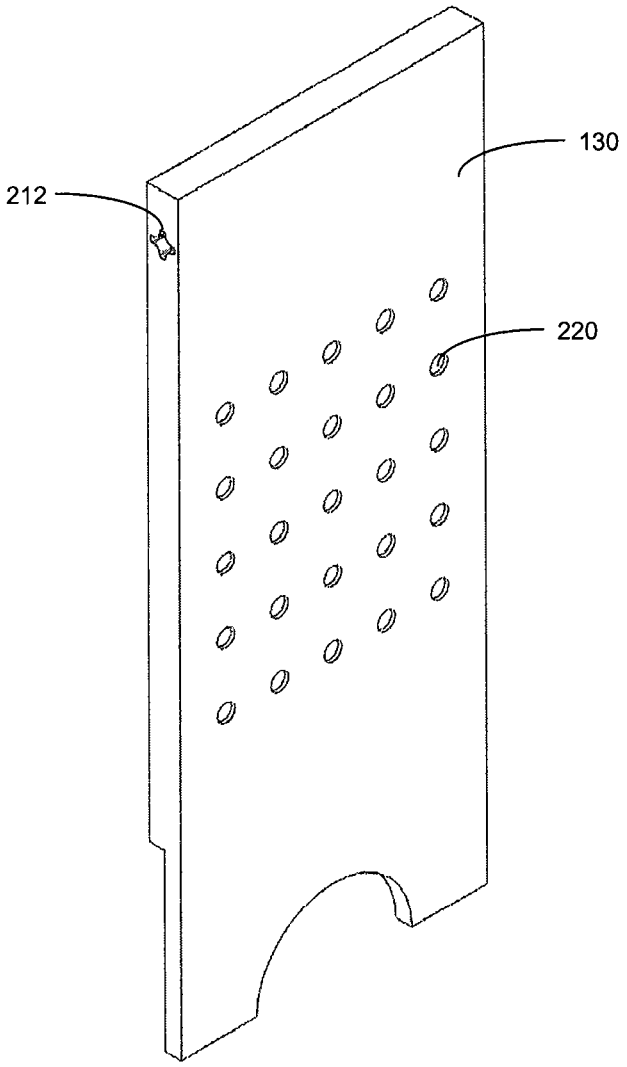
FIG. 4 is a perspective view of the supporting leg according to one embodiment of the invention.

The pivot means according to one preferred embodiment of the invention will be described below by combining with FIGS. 3-4. To show the structure of the pivot means and the connecting manner of the pivot means and other components clearly, FIG. 3 illustrates a section cut horizontally along a centre line of a pivot axle. As shown in FIGS. 3-4, the pivot means 210 comprises a pivot axle 211 and pivot holes 212. The pivot axle 211 is connected to the rear cover 110 in the recess 120, and two ends of the pivot axle 211 are fixed to two side faces of the recess 120, respectively. The pivot holes 212 are disposed on the side walls of the supporting leg 130. The pivot axle 211 passes through the pivot holes 212 to enable the supporting leg 130 to be pivotably connected to the recess 120. This pivot means 210 has the advantages, such as the small volume, the durability and the convenience for installation. Further, a top wall of the supporting leg 130 (referring to FIG. 4) is detachably connected to the side walls of the supporting leg 130, and notches whose opening directions are opposite are disposed on the top wall and the side walls respectively, to form the pivot holes 212 together. In this way, the supporting leg 130 can be installed in the recess 120 by simply removing the top wall from the side walls of the supporting leg 130, placing the pivot axle 211 in the notches of the side walls and installing the top wall on the side walls of the supporting leg 130.

As an example, in the preferred pivot means mentioned above, the pivot axle 211 may be in the shape of a tube, and at least one of the two ends of the pivot axle 211 is fixed to the rear cover 110 by the through-hole (mentioned as the through-hole through which the electric wire of the speaker passes). The portion of the pivot axle 211 located internally in the supporting leg 130 is provided with an aperture (not shown), and the electric wire of the speaker passes through the aperture, an inner cavity of the pivot axle 211 and the through-hole to extend into the rear cover 110, so that the electric wire for connecting the speaker is buried internally.

Figure 5:
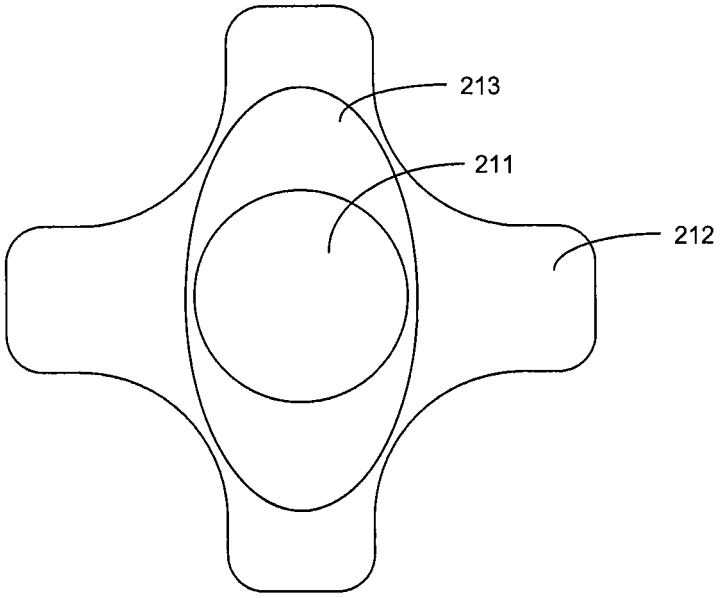
FIG. 5 is a schematic view of the position-limiting component according to one embodiment of the invention.

In order to maintain that the supporting leg 130 is stationary relative to the rear cover 110 when the supporting leg 130 is in the retracting position and the unfolding position respectively, preferably, the pivot means 210 further comprises a position-limiting component. The position-limiting component limits the supporting leg 130 to the retracting position and the unfolding position when the supporting leg 130 is at the retracting position and the unfolding position, respectively. As an example, the position-limiting component may include position-limiting blocks 213 disposed on the pivot axle 211 and position-limiting slots disposed on the supporting leg 130, as shown in FIG. 3. The positions of the position-limiting blocks 213 may correspond to the positions of the pivot holes 212 mentioned above, such that the pivot holes 212 may also have an additional function for limiting the position by changing the shapes of the pivot holes 212. As shown in FIG. 3 and FIG. 5, the position-limiting blocks 213 are contained in the pivot holes 212, the position-limiting components 213 protrude toward opposite directions along the radial directions of the pivot axle 211. The pivot holes 212 are in the shapes of "+" to form the position-limiting holes. When the position-limiting components 213 extends along two extending directions of the shapes of "+" in the pivot holes 212, the supporting leg 130 can be limited at the retracting position and the unfolding position, respectively. Of course, the position-limiting components may also have other structures, and they are not limited to the above structures provided by the invention. And in the above structures, the shapes of the position-limiting holes are relevant to the angle between the supporting leg 130 and the rear cover 110, and they are not necessarily in the shapes of "+". Those skilled in the art can adjust the structures of the position-limiting components according to the actual application.

Return to FIG. 2, the angle "a" between the supporting leg 130 and the rear cover 110 is 60°-120° such that the support of the supporting leg 130 is stable. If the angle "a" is too small, the angle "b" between the supporting leg 130 and the table surface may be greater than 90°. The flat panel electronic device 100 is easy to be pulled down when the user touches the screen of the flat panel electronic device 100. If the angle is too great, the length of the supporting leg 130 is not in full use. That is, a relatively longer supporting leg 130 is required to support the rear cover 110 to a right height.

Preferably, a thickness of the supporting leg 130 may be less than or equal to 1 cm to avoid influencing the whole thickness of the flat panel electronic device 100. Under the premise that the supporting leg 130 has enough strength and is able to contain the speaker, the thickness of the supporting leg 130 may be as small as possible.

Preferably, two side walls of the supporting leg 130 which are opposite in the thickness direction are provided with the sound holes 200, as shown in FIGS. 3-4. That is, the side wall facing the user and the other side wall opposite to the side wall of the supporting leg 130 are provided with the sound holes 200, when the flat panel electronic device 100 is placed on the table and the supporting leg 130 is pivoted to the unfolding position by the user. In this way, a good sound effect can be achieved in the area around the flat panel electronic device.

Preferably, the sound holes 220 are densely arranged on the side wall of the supporting leg 130. The sound holes 220 may be arranged in a matrix illustrated in FIGS. 3-4. The sound holes 220 may be staggered or arranged in other ways. The invention isn't intended to limit the arrangement of the sound holes 220, as long as they are densely arranged on the side wall of the supporting leg 130. And preferably, the diameters of the sound holes may be 0.1 mm-1 mm. In this way, the sound holes which are arranged densely on the supporting leg 130 and have smaller sizes influences neither the sound effect, nor the strength of the supporting leg 130.

Figure 6:
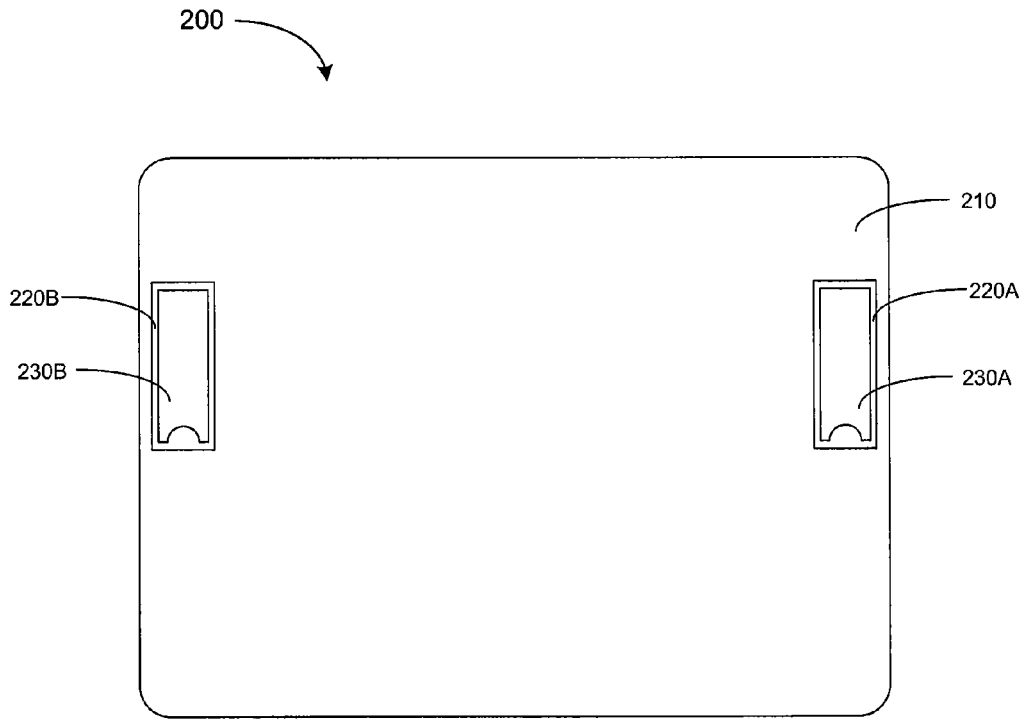
FIG. 6 is a back view of the flat panel electronic device according to another embodiment of the invention.

According to a preferred embodiment of the invention, a rear cover 210 of a flat panel electronic device 200 is provided with a first recess 220A and a second recess 220B as well as a first supporting leg 230A and a second supporting leg 230B, as shown in FIG. 6. The first supporting leg 230A and the second supporting leg 230B are connected in the first recess 220A and the second recess 220B, respectively. The structures and the connecting manners of the first supporting leg 230A and the second supporting leg 230B as well as the first recess 220A and the second recess 220B are essentially the same as the embodiments described before, except the difference that the first supporting leg 230A and the second supporting leg 230B are disposed proximally to the edges of two sides of the rear cover 210, respectively. It will be understood that the first recess 220A and the second recess 220B as well as the first supporting leg 230A and the second supporting leg 230B are disposed at the edges of the rear cover 210, correspondingly. The supporting legs being disposed at the edges of the two sides of the rear cover 210 can reduce the influence on the sound transmission from the flat panel electronic device itself to the user of the flat panel electronic device, and the aesthetics is maintained.

The rear cover of the flat panel electronic device provided by the invention is provided with the supporting leg, and the speaker is disposed in the supporting leg. Therefore, the angle of the screen of the flat panel electronic device relative to the user can be adjusted through the supporting leg to improve the user's comfort level in watching, and the surface to be placed (such as the table surface) has no influence on the sound effect. In addition, since the sound holes of the speaker are on the rear cover of the flat panel electronic device, the aesthetics of the flat panel electronic device also is uninfluenced.

According to another aspect of the invention, a flat panel electronic device is also provided. The flat panel electronic device includes any rear cover mentioned above. The structure of the rear cover can be referred to the above description, and it is not described herein.

The present invention has been described by the above-mentioned embodiments. However, it will be understand that the above-mentioned embodiments are for the purpose of demonstration and description and not for the purpose of limiting the present to the scope of the described embodiments. Moreover, those skilled in the art could appreciated that the present invention is not limited to the above mentioned embodiments and that various modifications and adaptations in accordance of the teaching of the present invention may be made within the scope and spirit of the present invention. The protection scope of the present invention is further defined by the following claims and equivalent scope thereof.

The invention claimed is:

1. A rear cover of a flat panel electronic device comprising:
an outer surface of the rear cover is provided with a recess;
a supporting leg, the supporting leg pivotably connected in the recess through a pivot means enabling the supporting leg to pivot between a retracting position and an unfolding position, the supporting leg configured to be contained in the recess when in the retracted position, and making an angle with the rear cover when being in the unfolding position;
a speaker disposed in the supporting leg;
sound holes are disposed at a position on a side wall of the supporting leg corresponding to the speaker;
a through-hole formed at a position of the rear cover corresponding to the pivot means; and
an electric wire of the speaker passing through the through-hole to extend into the rear cover.

2. The rear cover according to claim 1, wherein the supporting leg includes a first supporting leg and a second supporting leg, and the first supporting leg and the second supporting leg are disposed proximally to edges of two sides of the rear cover, respectively.

3. The rear cover according to claim 1, wherein two side walls of the supporting leg which are opposite in the thickness direction are provided with the sound holes.

4. The rear cover according to claim 1, wherein the sound holes are densely arranged on the side wall of the supporting leg, and diameters of the sound holes are 0.1 mm-1 mm.

5. The rear cover according to claim 1, wherein the angle is 60°-120°.

6. The rear cover according to claim 1, wherein a thickness of the supporting leg is less than or equal to 1 cm.

7. The rear cover according to claim 1, wherein the pivot means comprises a pivot axle and pivot holes, the pivot axle is connected to the rear cover in the recess, the pivot holes are disposed on the side walls of the supporting leg, the pivot axle passes through the pivot holes to enable the supporting leg to be pivotably connected to the recess.

8. The rear cover according to claim 7, wherein a top wall of the supporting leg is detachably connected to the side walls of the supporting leg, and notches whose opening directions are opposite are disposed on the top wall and the side walls respectively to form the pivot holes together.

9. The rear cover according to claim 7, wherein the pivot means further comprises a position-limiting component, the position-limiting component limits the supporting leg to the retracting position and the unfolding position when the supporting leg is at the retracting position and the unfolding position, respectively.

10. The rear cover according to claim 7, wherein the pivot axle is in a shape of tube, at least one of two ends of the pivot axle is fixed to the rear cover by the through-hole, a portion of the pivot axle located internally in the supporting leg is provided with an aperture, and the electric wire of the speaker passes through the aperture, the pivot axle and the through-hole to extend into the rear cover.

11. A flat panel electronic device comprising:
a rear cover;
an outer surface of the rear cover provided with a recess;
a supporting leg, the supporting leg pivotably connected in the recess through a pivot means enabling the supporting leg to pivot between a retracting position and an unfolding position, the supporting leg configured to be contained in the recess when in the retracted position; and making an angle with the rear cover when in the unfolded position;
a speaker disposed in the supporting leg;
sound holes are disposed at a position on a side wall of the supporting leg corresponding to the speaker;
a through-hole formed at a position of the rear cover which corresponding to the pivot means; and
an electric wire of the speaker passing through the through-hole to extend into the rear cover connected with an electric element of the flat panel electronic device.

12. The flat panel electronic device according to claim 11, wherein the supporting leg includes a first supporting leg and a second supporting leg, and the first supporting leg and the second supporting leg are disposed proximally to edges of two sides of the rear cover, respectively.

13. The flat panel electronic device according to claim 11, wherein two side walls of the supporting leg which are opposite in the thickness direction are provided with the sound holes.

14. The flat panel electronic device according to claim 11, wherein the sound holes are densely arranged on the side wall of the supporting leg, and diameters of the sound holes are 0.1 mm-1 mm.

15. The flat panel electronic device according to claim 11, wherein the angle is 60°-120°.

16. The flat panel electronic device according to claim 11, wherein a thickness of the supporting leg is less than or equal to 1 cm.

17. The flat panel electronic device according to claim 11, wherein the pivot means comprises a pivot axle and pivot holes, the pivot axle is connected to the rear cover in the recess, the pivot holes are disposed on the side walls of the supporting leg, the pivot axle passes through the pivot holes to enable the supporting leg to be pivotably connected to the recess.

18. The flat panel electronic device according to claim 17, wherein a top wall of the supporting leg is detachably connected to the side walls of the supporting leg, and notches whose opening directions are opposite are disposed on the top wall and the side walls respectively to form the pivot holes together.

19. The flat panel electronic device according to claim 17, wherein the pivot means further comprises a position-limiting component, the position-limiting component limits the supporting leg to the retracting position and the unfolding position when the supporting leg is at the retracting position and the unfolding position, respectively.

20. The flat panel electronic device according to claim 17, wherein the pivot axle is in a shape of tube, at least one of two ends of the pivot axle is fixed to the rear cover by the through-hole, a portion of the pivot axle located internally in the supporting leg is provided with an aperture, and the electric wire of the speaker passes through the aperture, the pivot axle and the through-hole to extend into the rear cover.

* * * * *